US009835385B2

(12) United States Patent
Ebster

(10) Patent No.: US 9,835,385 B2
(45) Date of Patent: Dec. 5, 2017

(54) THREE-CONDUCTOR AND FOUR-CONDUCTOR SYSTEM FOR SAVING ENERGY IN CONNECTION WITH DISTRICT HEAT

(71) Applicant: GEWOFAG GEBAEUDE SERVICE GMBH, Munich (DE)

(72) Inventor: Wilfried Ebster, Taufkirchen (DE)

(73) Assignee: GEWOFAG GEBAEUDE SERVICE GMBH (DE)

( * ) Notice: Subject to any disclaimer, the term of this patent is extended or adjusted under 35 U.S.C. 154(b) by 44 days.

(21) Appl. No.: 14/594,608

(22) Filed: Jan. 12, 2015

(65) Prior Publication Data

US 2015/0308752 A1 Oct. 29, 2015

Related U.S. Application Data

(63) Continuation of application No. 12/821,130, filed on Jun. 22, 2010, now abandoned.

(30) Foreign Application Priority Data

Feb. 3, 2010 (EP) ..... 10152550

(51) Int. Cl.
*F01K 27/00* (2006.01)
*F28F 1/00* (2006.01)

(52) U.S. Cl.
CPC ..... *F28F 1/00* (2013.01); *F01K 27/00* (2013.01)

(58) Field of Classification Search
CPC ..... F28F 1/00; F01K 27/00
See application file for complete search history.

(56) References Cited

U.S. PATENT DOCUMENTS 643,535 A 2/1900 Robertson
3,299,459 A * 1/1967 McCune ..... F16L 55/46 15/3.51

(Continued)

FOREIGN PATENT DOCUMENTS

DE 4443204 6/1996
DE 4443204 A1 * 6/1996 ..... F24D 10/00

(Continued)

OTHER PUBLICATIONS

DE4443204A1—machine translation.*

(Continued)

*Primary Examiner* — Nathaniel Herzfeld
(74) *Attorney, Agent, or Firm* — J.A. Lindeman & Co., PLLC

(57) ABSTRACT

The patent application relates to a district-heat consumer plant which is capable of being linked to a district-heat network and which comprises at least one heat-consumer which is capable of being supplied with heat from the district-heat network, the district-heat consumer plant comprising a port via which the district-heat consumer plant is capable of being linked to a district-heat reflux of the district-heat network, in order to withdraw heat from the district-heat reflux for the purpose of supplying the at least one heat-consumer. The patent application further relates to a district-heat network, to which a district-heat consumer plant is capable of being linked, the district-heat network comprising a district-heat reflux, and the district-heat reflux comprising a port for the district-heat consumer plant, in order to supply the district-heat consumer plant with heat from the district-heat reflux. Lastly, the patent application relates to a district-heat system which comprises a district-heat consumer plant and a district-heat network.

20 Claims, 8 Drawing Sheets

(56) References Cited

U.S. PATENT DOCUMENTS

| | | | | | |
|---|---|---|---|---|---|
| 3,838,813 | A | * | 10/1974 | Brosenius | F24D 10/006 237/13 |
| 3,890,787 | A | | 6/1975 | Margen | |
| 3,971,252 | A | | 7/1976 | Onoda | |
| 4,873,840 | A | * | 10/1989 | Gilliusson | F01K 17/02 237/12.1 |
| 4,883,087 | A | * | 11/1989 | Nielsen | F17D 5/02 137/458 |
| 5,026,171 | A | * | 6/1991 | Feller | G01K 17/12 374/40 |
| 5,125,753 | A | * | 6/1992 | Ries | G01F 1/42 374/40 |
| 5,178,324 | A | * | 1/1993 | Moesby | F24D 10/006 137/455 |
| 5,347,825 | A | * | 9/1994 | Krist | G05D 23/1919 165/295 |
| 5,573,183 | A | * | 11/1996 | Leskinen | F24D 10/00 237/19 |
| 2012/0279681 | A1 | | 11/2012 | Vaughan et al. | |

FOREIGN PATENT DOCUMENTS

| | | | | | |
|---|---|---|---|---|---|
| DE | 19616885 | | | 11/1997 | |
| DE | 19902851 | A1 | | 7/2000 | |
| DE | 19859364 | C2 | | 9/2001 | |
| DE | 102005044845 | A1 | | 3/2007 | |
| EP | 686836 | A1 | | 5/1995 | |
| EP | 1371910 | A2 | | 12/2003 | |
| EP | 1455140 | | | 9/2004 | |
| EP | 2182296 | | | 5/2010 | |
| EP | 2187135 | | | 5/2010 | |
| FI | EP 2182296 | A2 | * | 5/2010 | F24D 10/00 |
| FR | 2342469 | A1 | * | 9/1977 | F24D 19/1081 |
| RU | 2148211 | C1 | * | 4/2000 | |

OTHER PUBLICATIONS

RU2148211C1—machine translation.*

European Search Report for European Patent Application No. 10152550.9.

English Language Abstract of EP 0686836A1.

English Language Abstract of DE 19902851A1.

English Language Abstract of DE 4443204.

English Language Abstract of DE 19616885.

English Language Abstract of EP 2187135.

English Language Abstract of EP 1455140.

English Language Abstract of DE 19859364.

English Language Abstract of EP 1371910.

English Language Abstract of DE 102005044845.

* cited by examiner ( State of the Art )

THREE-CONDUCTOR AND FOUR-CONDUCTOR SYSTEM FOR SAVING ENERGY IN CONNECTION WITH DISTRICT HEAT

FIELD OF THE PATENT APPLICATION

The present patent application relates to a district-heat consumer plant for supplying heat to at least one heat-consumer from a district-heat network, said plant comprising a first heat-exchanger with a primary afflux.

BACKGROUND

From German printed patent specification DE 198 59 364 C2, for example, a heat-supply plant is known which is linked to a heat-supply network. The heat-supply plant routes heat-carriers away from a long-distance line via an afflux line. Said heat-carriers serve in each instance for supplying a heating circuit in which, in each instance, one or more heat-consumers may be arranged. The heat-consumers are connected to a reflux of the heat-supply network via a reflux line.

Furthermore, from European published application EP 1 371 910 A2 a domestic-connection station for district heat is known consisting of reservoirs, heat-transfer media, pumps, shut-off fittings, temperature sensors and a regulator as well as ports for afflux and reflux of district heat. This domestic-connection station comprises a hot-water distribution plant with a direct connection to the district-heat afflux.

Furthermore, from German published application DE 10 2005 044 845 A1 a drinking-water heating plant is known which includes a drinking-water heater as central component. A heat-source—which, for example, is a port to a supply of district heat—serves for the supply of heat.

SUMMARY

The task underlying the patent application is to make available a district-heat consumer plant that is improved in comparison with the known district-heat consumer plants. In particular, a district-heat consumer plant is to be made available, by means of which energy can be saved.

In all the claims the reference symbols have no restricting effect but are merely intended to improve the readability thereof.

The solution to the task as stated is possible by means of a district-heat consumer plant with the features of claim 1, a district-heat network with the features of claim 11, and a district-heat system with the features of claim 15.

By means of the district-heat consumer plant which is capable of being linked via a port to a district-heat reflux of the district-heat network, with the patent application it can be ensured that heat is withdrawn by the district-heat consumer plant from the district-heat reflux which, for example, may exhibit a temperature of up to 70° C. By this means, heat-consumers of the district-heat consumer plant can be supplied with heat. Advantageously, by means of the port of the district-heat reflux of the district-heat network a district-heat consumer plant can be supplied with heat from the district-heat reflux.

To be understood by the expression 'district-heat network' is a system via which heat or thermal energy generated in a district heating station can be transported from the district heating station to district-heat consumer plants, in order to supply the district-heat consumer plants with heat. A heat-supplier can accordingly transport the energy generated in the district heating station via the district-heat network, in order to make said energy available to the respective district-heat consumer plant which, for example, is installed in a building. Via a district-heat network, the heat or thermal energy generated in a district heating station can be transported from the district heating station to a plurality of district-heat consumer plants, in order to be able to supply the at least one heat-consumer of each district-heat consumer plant with heat. For this purpose, the district-heat network may, for example, comprise branches which, for example, may be of radial, annular or meshed construction. Several district heating stations may also have been connected to one another, in order that supply problems can be avoided in the event of the failure of a district heating station. For the purpose of drawing heat from the district heating station, the district-heat network may, for example, have been connected to the district heating station via at least one heat-exchanger. The district-heat network may, for example, begin at the point in the district heating station at which the medium heated by the district heating station is made available. But, in accordance with the patent application, the district-heat network may also include the district heating station. The district-heat network consists of a district-heat afflux and a district-heat reflux. The district-heat afflux is the part of the district-heat network via which a district-heat consumer plant is able to draw a medium heated by the district heating station. In the district-heat consumer plant, for example in a domestic plant, heat can be withdrawn from this medium, in order to be able to supply heat-consumers of the district-heat consumer plant with heat. Subsequently the medium can be conducted in the district-heat reflux, in order to be able to transport said medium back to the district heating station. In the district-heat reflux the medium which has been cooled by several district-heat consumer plants can accordingly be transported back again to the district heating station. The district heating station may, for example, be a heating station, a heating-and-power station with combined heat and power generation, a geothermal plant, a biogas plant or a bio woodchip plant. The medium conducted in the district-heat network may, for example, be heat and/or steam.

It is an attainable advantage of the district-heat consumer plant which is capable of being linked to the district-heat reflux that residual heat from the district-heat reflux can be utilised which is actually no longer provided for the purpose of utilisation, because in the district-heat reflux the medium from which heat has already been withdrawn by district-heat consumer plants is transported back to the district heating station. The medium being conducted in the district-heat reflux may, for example, attain a temperature of up to 70° C., representing a considerable source of energy. Through the utilisation of the residual heat from the district-heat reflux, advantageously the situation can be avoided that the medium being transported in the district-heat reflux has to be cooled prior to supply to the district heating station. Furthermore, by means of the patent application it can be made possible to utilise effectively the energy available in the form of residual heat, in order consequently to save energy. This may result in a reduced energy consumption of the district-heat consumer plant. Embodiments of the patent application are conceivable, by means of which considerable savings of energy can be made possible, so that the power rating of the district-heat consumer plant can be reduced by about 20%, for example. This may result in reduced operating costs of the district-heat consumer plant.

Advantageously, by means of the district-heat consumer plant which is capable of being linked to the district-heat reflux via the port an increase in the output of the district-heat consumer plant is attainable, since an additional heat-source can be utilised by virtue of the drawing of heat from the district-heat reflux. By virtue of the increase in output, advantageously the heating load of the building can be reduced, or the supply of low-energy houses with district heat can be facilitated. For instance, in the case of a low-energy house a preheating of hot drinking water by district heat can be enabled. This is particularly advantageous also for the reason that in the case of low-energy houses the thermal output needed for heating up hot drinking water frequently exceeds the district-heat power rating of the house, which is ordinarily ascertained via the thermal output needed for the purpose of heating the low-energy house. Of course, the preheating of hot drinking water from, for example, about 10° C. to, for example, about 30° C. to 40° C. by the first heat-exchanger is not restricted to low-energy houses but is conceivable for any district-heat supply plants.

The district-heat consumer plant that is linked in accordance with the patent application may be especially suited for supplying low-energy consumers with heat. Advantageously, the energy demand of low-energy consumers can be fully met by the heat recovered from the district-heat reflux. Such low-energy consumers may be, for example, underfloor heating systems, wall heating systems or ceiling heating systems, which, for example, are utilised for the purpose of heating warehouses, swimming pools or market gardens.

A further attainable advantage of the utilisation of heat from the district-heat reflux is that the temperature of the medium being transported in the district-heat reflux, also designated as the reflux temperature, can be reduced. Embodiments of the patent application are conceivable that can even enable a considerable reduction of the reflux temperature. Advantageously, by virtue of the reduction of the reflux temperature it can be ensured that the medium flowing in the district-heat reflux to the district heating station has to be cooled less or even not at all prior to supply to the district heating station. This may result in an increase in efficiency and/or in an increase in the thermal output of the district-heat network, because in order to enable an effective operation of the district heating station a certain reflux temperature of the supplied medium must not be exceeded. By virtue of the patent application, the elaborate cooling measures that are frequently required by reason of high reflux temperatures may advantageously be reduced or even completely discontinued. This may result in an economically favourable operation of the district-heat network and of the district heating station, whereby the efficiency and/or the thermal output of the district-heat network may be increased by 20%-30%, for example. Advantageously, by virtue of the increase in efficiency and/or in thermal output, energy can be saved. An increase in efficiency and/or an increase in output may prove to be a particular advantage, for example, in the case of geothermal plants. By virtue of the lowering of, in many embodiments, very high reflux temperatures, even an enormous increase in efficiency is attainable.

Of course, the advantages that are attainable by the district-heat consumer plant may similarly also be attainable by means of the district-heat network configured in accordance with the patent application and/or by means of the district-heat system according to the patent application.

Advantageous developments and further developments, which may be employed individually or in combination with one another, are the subject-matter of the dependent claims.

In a preferred embodiment of the patent application, the district-heat consumer plant comprises a reflux transfer station, in order to withdraw heat from the district-heat reflux via the reflux transfer station. More preferably, the district-heat consumer plant is capable of being linked to the district-heat reflux via the reflux transfer station. This means that the medium being conducted in the district-heat reflux flows out of the district-heat reflux through the reflux transfer station, in order to be cooled for the purpose of supplying heat. After cooling, the medium can flow back again through the reflux transfer station into the district-heat reflux. More preferably, the reflux transfer station is of the type of a transfer station. Of course, a reflux transfer station according to the patent application may also be part of the district-heat network.

By means of a transfer station, a district-heat consumer plant can be linked to a district-heat network. In this case, in accordance with the patent application the transfer station may be part of the district-heat consumer plant and/or part of the district-heat network. Advantageously, heat can be delivered to the district-heat consumer plant from the district-heat network via the transfer station. More preferably for this purpose, a medium flows out of the district-heat network through the transfer station into the district-heat consumer plant, in order to be able to be cooled in the district-heat consumer plant for the purpose of supplying heat, and subsequently flows through the transfer station back into the district-heat network. By virtue of the transfer station, advantageously a fluidic connection between district-heat network and district-heat consumer plant can be established. More preferably, the transfer station comprises a differential-pressure regulator, in order to be able to adapt the pressure ratios existing in the district-heat network to the district-heat plant. More preferably, the transfer station comprises a controllable regulating valve, in order to withdraw heat from the district-heat network only on demand. Such a regulating valve may, for example, be a motor-driven regulating valve or a jet pump. A particularly preferred transfer station comprises a calorimeter, in order to record the heat withdrawn from the district-heat network. Advantageously, a heat-supplier may by this means charge the operator of the heat-consumer plant for the heat delivered. Furthermore, a transfer station may comprise, for example, shut-off valves, bleed valves and/or manometers.

In another preferred embodiment of the patent application, the district-heat consumer plant comprises a first heat-exchanger with a primary afflux and with a primary reflux, the primary afflux and the primary reflux of the first heat-exchanger being capable of being linked to the district-heat reflux, in order to withdraw heat from the district-heat reflux. It is an attainable advantage of the first heat-exchanger which is capable of being linked to the district-heat reflux that residual heat from the district-heat reflux can be utilised which is actually no longer provided for the purpose of utilisation. Advantageously, by means of the first heat-exchanger which is capable of being linked to the district-heat reflux an increase in output of the district-heat consumer plant is attainable, since by virtue of the drawing of heat from the district-heat reflux an additional heat-source can be utilised. The first heat-exchanger which is capable of being linked in accordance with the patent application may be particularly suitable for supplying low-energy consumers with heat. Furthermore, the first heat-exchanger according to the patent application is easily capable of being retrofitted for existing district-heat consumer plants, since existing installations, for example in a building, do not have to be changed. Advantageously, for a retrofitting only the plant that is present in an installation space has to be partially rebuilt, and also an additional port to the line of the district-heat reflux has to be fitted. Since the district-heat supply lines of very many district-heat consumer plants are conducted through cellars, a third or fourth port for the first heat-exchanger can advantageously be created cost-effectively without great effort.

A heat-exchanger, which may also be designated as a heat-transfer medium, is an apparatus for transferring heat from a primary system to a secondary system. The primary afflux is the port of the primary side of the heat-exchanger via which a medium can be supplied from the primary system to the heat-exchanger, in order to withdraw heat from this medium and to transfer the withdrawn heat to the secondary system. The primary afflux is then linked to the district-heat reflux, when the medium being conducted in the district-heat reflux can flow out of the district-heat reflux into the first heat-exchanger via the primary afflux.

In a particularly preferred embodiment of the patent application, the first heat-exchanger comprises a primary reflux which is linked to the district-heat reflux. In this case the primary reflux is the port of the primary side of the heat-exchanger, through which the medium which was supplied to the heat-exchanger by the primary afflux after perfusing the heat-exchanger and after release of heat is able to leave the heat-exchanger again. By this means, it can be ensured that the medium from the district-heat reflux flows via the primary afflux into the first heat-exchanger, perfuses the latter, and flows back into the district-heat reflux via the primary reflux. In other words, for the purpose of transfer of heat the first heat-exchanger is flowed through by the medium from the district-heat reflux on the primary side, in order to heat a medium of a secondary system linked to the secondary side and in this way to transfer heat from the district-heat reflux to the secondary system. A particularly preferred district-heat consumer plant is linked to the district-heat network only via the first heat-exchanger, in order to supply low-energy consumers and/or low-temperature systems with heat. Such low-temperature systems may be low-temperature heating plants and/or low-temperature deaerating plants. Via such a district-heat consumer plant, a warehouse or a market garden, for example, can be heated, a low-energy house or an underfloor heating system can be operated.

More preferably, the primary afflux of the first heat-exchanger is capable of being linked to the district-heat reflux of the district-heat network. More preferably, the primary afflux of the first heat-exchanger is capable of being linked to the district-heat reflux via a reflux transfer station. Advantageously by this means, a medium being conducted in the district-heat reflux can flow through the reflux transfer station to the primary afflux of the first heat-exchanger. More preferably, the primary reflux of the first heat-exchanger is capable of being linked to the district-heat reflux of the district-heat network. More preferably, the primary reflux of the first heat-exchanger is capable of being linked to the district-heat reflux via a reflux transfer station. The primary side of the first heat-exchanger, which comprises the primary afflux and/or the primary reflux, is accordingly more preferably capable of being linked to the district-heat reflux via the reflux transfer station. By means of the primary afflux and/or primary reflux of the first heat-exchanger which is capable of being linked to the district-heat reflux of the district-heat network, with the patent application it can be ensured that heat is withdrawn by the first heat-exchanger from the district-heat reflux, which, for example, may exhibit a temperature of up to 70° C., in order to transfer said heat to a heat-consumer.

More preferably, the first heat-exchanger is of the type of a heat-exchanger that comprises a primary side and a secondary side, whereby a primary system and a secondary system can be linked to the primary side and to the secondary side, respectively. By this means, heat can be transferred from the primary system to the secondary system. In this case the primary afflux and also the primary reflux are considered to be part of the primary side, and a secondary afflux and also a secondary reflux are considered to be part of the secondary side. More preferably, the primary system and secondary system linked to the primary side and secondary side are separated from one another, i.e. no medium is exchanged between the two systems in the course of the transfer of heat. The medium being conducted in the primary or secondary system may be, for example, water and/or steam.

In another preferred embodiment, a feed pump is arranged between the primary afflux of the first heat-exchanger and the district-heat reflux, in order to be able to convey the medium flowing into the district-heat reflux through the first heat-exchanger. Advantageously, by means of the feed pump the medium can be conveyed out of the district-heat reflux and through the first heat-exchanger, even in the case of low pressure ratios in the district-heat reflux, for example by reason of low pumping power of the supplier of district heat. In a particularly preferred embodiment of the patent application, the feed pump is arranged between the primary reflux of the first heat-exchanger and the district-heat reflux. By this means, the suction effect of the feed pump can be improved, which may result in an improvement of the transfer of heat of the first heat-exchanger and hence in an increase in output. This may prove to be an advantage, above all in the case of high pressures and/or high flow velocities within the district-heat reflux.

In another particularly preferred embodiment of the patent application, the district-heat reflux comprises a throttle valve. More preferably, the throttle valve is situated downstream of the port of the primary afflux of the first heat-exchanger to the district-heat reflux in the direction of flow. More preferably, the throttle valve is situated upstream of the port of the primary reflux of the first heat-exchanger to the district-heat reflux in the direction of flow. The direction of flow of the district-heat reflux is the direction in which a medium is flowing in the district-heat reflux, for example in the direction of the district heating station. By means of the throttle valve, the medium being conducted in the district-heat reflux can be dammed up in such a way that an increase in the pressure and/or in the flow velocity in the primary afflux of the first heat-exchanger can be obtained. By this means, the heat can be transferred to the heat-consumers more effectively. Of course, the patent application encompasses embodiments in which the district-heat consumer plant comprises the throttle valve and the feed pump both individually and in combination with one another.

In a preferred embodiment of the patent application, the district-heat consumer plant comprises a port via which the district-heat consumer plant is capable of being linked to a district-heat afflux of the district-heat network, in order to withdraw heat from the district-heat afflux. By this means, it can be ensured that heat-consumers of the district-heat consumer plant can be supplied with heat.

In another preferred embodiment of the patent application, the district-heat consumer plant comprises an afflux transfer station, in order to withdraw heat from the district-heat afflux via the afflux transfer station. More preferably, the district-heat consumer plant is capable of being linked to the district-heat afflux via an afflux transfer station, in order to withdraw heat from the district-heat afflux via the afflux transfer station. This means that the medium being conducted in the district-heat afflux flows out of the district-heat afflux through the afflux transfer station, in order to be cooled for the purpose of supplying heat. After cooling, the medium can flow back again through the afflux transfer station into the district-heat network, more preferably into the district-heat reflux. More preferably, the afflux transfer station is of the type of a transfer station. Of course, an afflux transfer station according to the patent application may also be part of the district-heat network.

Developing the patent application further, there is preferably provision that the district-heat consumer plant comprises a second heat-exchanger with a primary afflux and with a primary reflux, the primary afflux being capable of being linked to a district-heat afflux of the district-heat network, and the primary reflux being capable of being linked to the district-heat reflux, in order to withdraw heat from the district-heat afflux. More preferably, the district-heat consumer plant comprises a second heat-exchanger with a primary afflux, the primary afflux of the second heat-exchanger being capable of being linked to a district-heat afflux of the district-heat network for the purpose of transfer of heat. By means of the second heat-exchanger, advantageously heat can be withdrawn from a medium from the district-heat afflux, in order to be able to supply a heat-consumer with heat. More preferably, the second heat-exchanger comprises a primary reflux which is linked to the district-heat reflux. In a particularly preferred embodiment of the patent application, the second heat-exchanger is capable of being linked to the district-heat network by its primary side via the primary afflux and the primary reflux. In this embodiment, the medium conducted into the district-heat afflux for the purpose of transfer of heat flows out of the district-heat afflux via the primary afflux of the second heat-exchanger into the second heat-exchanger, perfuses the latter, and flows into the district-heat reflux of the district-heat network via the primary reflux. More preferably, the second heat-exchanger is of the type of a heat-exchanger that comprises a primary side and a secondary side, the medium from the district-heat afflux perfusing the heat-exchanger on the primary side, in order to be able to transfer heat to a secondary system which is linked to the secondary side. By means of the second heat-exchanger, advantageously a higher temperature can be made available than by means of the first heat-exchanger, since the medium being conducted in the district-heat afflux exhibits a higher temperature than the medium being conducted in the district-heat reflux. This higher temperature may, for example, be utilised for the purpose of heating up and/or for the purpose of reheating hot drinking water and/or for the purpose of meeting peak loads. Advantageously, a district-heat consumer plant with first and second heat-exchangers according to the patent application can accordingly be operated in energy-saving manner and can make sufficient heat available at any time.

Advantageously, by virtue of the patent application two zones can be created for transfer of heat, namely from the district-heat reflux via the first heat-exchanger, and from the district-heat afflux via the second heat-exchanger. In the first zone, more preferably heat is transferred from the district-heat reflux, which may exhibit a temperature of up to 70° C., to the district-heat consumer plant. By this means, the energy of the district-heat reflux can be utilised effectively. In the second zone, more preferably heat is transferred from the district-heat afflux to the district-heat plant. By virtue of the transfer of heat via the two zones, a higher efficiency of the district-heat network and/or of the district-heat plant can be attained, because less medium, for example about 30% less, has to be withdrawn from the district-heat afflux for the same thermal output of the district-heat plant. Advantageously by this means, the dimensions of the pipelines, fittings and pumps can be made smaller.

On the basis of the following example, some of the advantages that are attainable by virtue of the transfer of heat according to the patent application via the two zones will be elucidated. In the tariff agreements of the district-heat suppliers so-called penalty fees and premium fees are incorporated. The price demanded is determined by the setting of the agreed volume of water. It follows from this that the greater the spread of temperature between afflux and reflux of the primary circuit, the smaller the volume of water and the better the efficiency of the entire system. In the case of a power rating of 100 kW and a thorough cooling of, for example, 50 K, a quantity of water of 1.72 m.sup.3/h is requested. In the case of a spread of 40 K, a quantity of water of 2.15 m.sup.3/h has to be set. From this it becomes evident that only by means of large spreads of temperature which are provided in the tariff agreements can great costs be saved. On the basis of this example, in addition it becomes clear that the district-heat network can be relieved via a lowering of the reflux temperature, since less district-heat water has to be withdrawn from the district-heat afflux for the same heating power. Many generators of district heat are already compelled nowadays to employ larger district-heat pumps with higher pumping powers and to undertake pressure boosts in the district-heat network, in order to supply the customers with the agreed power. This may even have the result that new connections are no longer approved, or the network of pipes has to be enlarged. These problems can be countered advantageously by the embodiment, according to the patent application, of the district-heat plant. Especially in the case of geothermal plants in which the deep water is conveyed out of the underground reservoir at very high temperatures, the temperature of the district-heat reflux should amount maximally to 30-40° C., in order to be able to operate the plant economically. This can also advantageously be enabled by the patent application.

In a preferred embodiment of the patent application, the primary afflux and the primary reflux of the second heat-exchanger are capable of being linked to the district-heat afflux and to the district-heat reflux via the afflux transfer station. The second heat-exchanger is accordingly capable of being linked to the district-heat afflux via the afflux transfer station. More preferably, the primary afflux of the second heat-exchanger is capable of being linked to the district-heat afflux of the district-heat network. More preferably, the primary afflux of the second heat-exchanger is capable of being linked to the district-heat reflux via the afflux transfer station. Advantageously by this means, a medium being conducted in the district-heat afflux can flow through the afflux transfer station to the primary afflux of the second heat-exchanger. More preferably, the primary reflux of the second heat-exchanger is capable of being linked to the district-heat reflux of the district-heat network. More preferably, the primary reflux of the second heat-exchanger is capable of being linked to the district-heat reflux via the afflux transfer station. The primary side of the second heat-exchanger, which comprises the primary afflux and/or the primary reflux, is accordingly more preferably capable of being linked to the district-heat network via the afflux transfer station. By means of the primary afflux which is capable of being linked to the district-heat afflux and/or by means of the primary reflux of the second heat-exchanger which is capable of being linked to the district-heat reflux, a withdrawal of heat from the district-heat afflux can be obtained, in order to transfer said heat to a heat-consumer.

In accordance with the patent application, there is preferably provision that the primary reflux of the first heat-exchanger and the primary reflux of the second heat-exchanger are connected to one another, in order to be jointly capable of being linked to the district-heat reflux of the district-heat network. More preferably, the primary reflux of the first heat-exchanger is to the reflux transfer station and/or the primary reflux of the second heat-exchanger is to the afflux transfer station, in order subsequently to be capable of being linked to the district-heat reflux of the district-heat network. Such a system, in which the primary refluxes of the first and second heat-exchangers are connected to one another and are jointly linked to the district-heat reflux of the district-heat network, may also be designated as a three-conductor system, since the district-heat consumer plant comprises three ports to the district-heat network. These ports are the primary afflux of the first heat-exchanger to the district-heat reflux, the primary afflux of the second heat-exchanger to the district-heat afflux, and also the common port of the primary reflux of the first and second heat-exchangers to the district-heat reflux. Advantageously, a district-heat consumer plant constructed as a three-conductor system may be capable of being liked to the district-heat network with minimal costs and technical effort. In the case of a three-conductor system, a reduction of the temperature of the district-heat reflux from approximately 70° C. to a mixing temperature of approximately 45° C. can be enabled, satisfying the maximal 45° C. demanded by most district-heat operators since 2007. For this purpose, the medium flowing out of the first heat-exchanger via the primary reflux may, for example, exhibit a temperature of approximately 30° C.-40° C., and/or the medium flowing out of the second heat-exchanger via the primary reflux may exhibit a temperature of about 55° C. This results in a mixing temperature of approximately 45° C.

Developing the patent application further, there is preferably provision that the primary refluxes of the first and second heat-exchangers are capable of being linked to the district-heat reflux of the district-heat network separately from one another. More preferably, the primary reflux of the first heat-exchanger is capable of being linked to the district-heat reflux of the district-heat network via the reflux transfer station, and/or the primary reflux of the second heat-exchanger is capable of being linked to the district-heat reflux of the district-heat network via the afflux transfer station. Such a system may also be designated as a four-conductor system, since the district-heat consumer plant is capable of being linked to the district-heat network via four ports. These ports are the primary afflux of the first heat-exchanger to the district-heat reflux, the primary afflux of the second heat-exchanger to the district-heat afflux, the primary reflux of the first heat-exchanger to the district-heat reflux, and also the primary reflux of the second heat-exchanger to the district-heat reflux. By virtue of the four-conductor system, a higher degree of safety in connection with the supply of heat is attainable, since the four-conductor system advantageously comprises two separate heat-exchangers with separate ports. Should, for example, one of the two heat-transfer media fail, at least a basic heat supply can continue to be ensured by the remaining heat-exchanger.

In a preferred embodiment of the patent application, the district-heat consumer plant comprises a heat-consumer system that is capable of being supplied with the heat recovered from the district-heat reflux. More preferably, the district-heat consumer plant comprises a heat-consumer system that is capable of being supplied with heat by the first heat-exchanger. The heat withdrawn from the district-heat reflux by the first heat-exchanger can accordingly be supplied to the heat-consumer system. More preferably, the heat-consumer system is linked to a secondary reflux and/or to a secondary afflux of the first heat-exchanger. In this case the secondary reflux is the port of the secondary side of the heat-exchanger that is linked to the line of the heat-consumer system from which the medium of the heat-consumer system which is to be heated is delivered. The secondary afflux is the port of the secondary side of the heat-exchanger that is linked to the line of the heat-consumer system via which the medium of the heat-consumer system which is heated by the heat-exchanger is supplied to the heat-consumer system. The medium of the heat-consumer system can accordingly be conducted via the secondary reflux into the first heat-exchanger for the purpose of heating, can perfuse the latter, and, after it has been heated, flow back into the heat-consumer system via the secondary afflux. More preferably, the heat-consumer system comprises for this purpose a pump which more preferably acts as a circulating pump. But the pump may also act as a heating pump or charge pump. The heat-consumer system is indirectly connected to the district-heat network via the first heat-exchanger, since no medium is exchanged between the district-heat network and the heat-consumer system.

In another preferred embodiment, at least one heat-consumer is linked to the heat-consumer system, in order to be able to be supplied with heat by the first heat-exchanger via the heat-consumer system. Via the heat-consumer system, heat from the first heat-exchanger, which draws the heat from the district-heat reflux, can accordingly be delivered to heat-consumers such as, for example, preheaters for preheating media that are to be brought to high temperatures, preheaters for cold drinking water or heating systems, underfloor heating systems, ceiling and/or wall heating systems, heating systems of swimming pools, heating systems for heating bath water, heating systems of market gardens, residential stations or low-energy plants. Via a residential station, the heating system and the hot-water supply of a dwelling can be enabled. Since in the case of a residential station the volume of the hot drinking water frequently falls below 3 l, and consequently by reason of statutory regulations the hot drinking water does not have to be heated to the 60° C. prescribed by law, the entire heat supply of the residential station may be attainable via the first heat-exchanger according to the patent application.

In another preferred embodiment of the patent application, an air-conditioning plant is capable of being supplied with heat from the district-heat reflux. More preferably, the air-conditioning plant is linked for this purpose to the heat-consumer system. An air-conditioning plant may, for example, be constructed as an air-heating system and may, for example, comprise an air-heater which may be constructed as a heating element. By means of the air-conditioning plant, outside air which is to be conducted into a building can be heated. More preferably, the air-conditioning plant comprises a first stage, for example a preheater which is capable of being supplied with heat from the district-heat reflux, in order to preheat air. By means of the first stage, outside air can advantageously be preheated. More preferably, the first stage is linked to the heat-consumer system. More preferably, the air-conditioning plant comprises a second stage which is capable of being supplied with heat from the district-heat afflux, in order to reheat air. The second stage may, for example, have been constructed as a heating boiler.

More preferably, the heat-consumer system is constructed as a circuit, the medium of the heat-consumer system flowing from a heat-consumer to the first heat-exchanger in order to be heated, and subsequently flowing from the first heat-exchanger to a heat-consumer, in order to supply the latter with heat. More preferably, the heat-consumer system comprises a pump, in order to pump the medium of the heat-consumer system through the lines of the heat-consumer system from the first heat-exchanger to a heat-consumer and back again. More preferably, the heat-consumers are connected via connecting lines to an afflux of the heat-consumer system and to a reflux of the heat-consumer system, warm medium of the heat-consumer system being delivered to the heat-consumer via the afflux of the heat-consumer system, said medium being cooled by the heat-consumer and conducted back again into the reflux of the heat-consumer system. More preferably, a pump is arranged in the connecting line via which the heat-consumer is linked to the afflux and/or to the reflux. This pump may have been provided as an alternative or in addition to the pump of the heat-consumer system.

More preferably, there is linked to the heat-consumer system a heating-system preheater via which the medium of a living-space heating circuit can be preheated. Via a heating-system residual heater, which more preferably is connected to the secondary afflux and to the secondary reflux of the second heat-exchanger, the medium of the living-space heating circuit can be heated up to a defined temperature. The heating-system preheater and the heating-system residual heater are more preferably connected in series. Advantageously, a heat-consumer, such as, for example, a heating circuit, the heat demand of which cannot be met fully by the first heat-exchanger, can accordingly be furnished with heat for the purpose of preheating from the first heat-exchanger and with heat for the purpose of residual heating from the second heat-exchanger.

Developing the patent application further, there is preferably provision that the district-heat consumer plant comprises a three-way valve, by which the heat-consumer system is capable of being supplied with the heat recovered from the district-heat afflux. More preferably, the heat-consumer system is capable of being supplied with ancillary heat via the three-way-valve by the second heat-exchanger of the district-heat consumer plant. Should the medium in the heat-consumer system accordingly not be capable of being heated sufficiently via the heat recovered from the district-heat reflux, which, for example, is delivered from the first heat-exchanger, advantageously a medium that has been heated by the second heat-exchanger can be admixed via the three-way valve. Via the three-way valve, the heat-consumer system can be supplied with heat by the first and/or second heat-exchanger. The heat-consumer system can accordingly be supplied with ancillary heat on demand by the second heat-exchanger through the three-way valve, so that in the event of insufficient delivery of heat by the first heat-exchanger, for example in the case of peak loads or in the case of a defective first heat-exchanger, the second heat-exchanger supplies heat to the heat-consumer system. By this means, it can advantageously be ensured that a heat-consumer linked to the heat-consumer system can be supplied with the necessary heat at any time. More preferably, the secondary afflux of the second heat-exchanger and the secondary afflux of the first heat-exchanger are linked to the three-way valve. More preferably, the secondary reflux of the second heat-exchanger and the secondary reflux of the first heat-exchanger are linked to the three-way valve.

In one embodiment of the patent application, the district-heat consumer plant comprises a drinking-water heater for the purpose of heating hot drinking water, which is capable of being supplied with the heat that is capable of being recovered from the district-heat reflux for the purpose of preheating the hot drinking water. More preferably, the drinking-water heater is capable of being supplied with heat by the first heat-exchanger for the purpose of preheating the hot drinking water. Advantageously by this means, hot drinking water to be heated in stepwise manner by heat from the district-heat reflux can be preheated, in order in the course of a subsequent residual heating of the hot drinking water to need less thermal energy by reason of the smaller temperature difference. For instance, cold water at 10° C., which is to be heated to 60° C., can be preheated to 40° C. via the heat delivered by the first heat-exchanger. Subsequently, instead of heating cold water at 10° C. to 60° C. only warm water at 40° C. has to be heated with the second heat-exchanger to 60° C. By virtue of the preheating of the hot drinking water via the first heat-exchanger, the energy consumption of the district-heat consumer plant can be reduced further. Embodiments of the patent application are conceivable in which the efficiency of the district-heat consumer plant is considerably increased. More preferably, the drinking-water heater comprises a first partial drinking-water heater, the first partial drinking-water heater being capable of being supplied with heat by the first heat-exchanger for the purpose of preheating the hot drinking water. More preferably, at least 30% of the temperature difference derived from the temperature to which the hot drinking water is to be heated and the temperature of the hot drinking water to be heated is supplied to the hot drinking water by the first heat-exchanger. For instance, cold hot drinking water at 10° C. is heated by the first partial drinking-water heater to at least 40° C. if the hot drinking water is to be heated by the drinking-water heater to 60° C. More preferably, the first partial drinking-water heater is constructed as a heat-exchanger, which more preferably is arranged in a lower region of the drinking-water heater. In accordance with the patent application, the first partial drinking-water heater may be constructed as a preheating system of arbitrary type, for example as a plate-type exchanger, countercurrent exchanger or preheating reservoir. More preferably, the first partial drinking-water heater is linked to the heat-consumer system. By means of the first heat-exchanger, of course, further heat-consumers, which have a high heat demand which cannot be fully met by the first heat-exchanger, can also be supplied with heat for the purpose of preheating.

In a preferred embodiment of the patent application, the district-heat consumer plant comprises a drinking-water heater for the purpose of heating hot drinking water, said heater being capable of being supplied with the heat that is capable of being recovered from the district-heat afflux for the purpose of residual heating of the hot drinking water. More preferably, the drinking-water heater is capable of bring supplied with heat by the second heat-exchanger for the purpose of residual heating of the hot drinking water. More preferably, the drinking-water heater comprises a second partial drinking-water heater, the second partial drinking-water heater being capable of being supplied with heat by the second heat-exchanger for the purpose of residual heating of the hot drinking water to a preset temperature, for example 60° C. More preferably, the hot drinking water is heated by the second partial drinking-water heater to a preset temperature, for example to 60° C. More preferably, the second partial drinking-water heater is constructed as a heat-exchanger which more preferably is arranged in an upper region of the drinking-water heater. In accordance with the patent application, the second partial drinking-water heater may also have been constructed as a preheating system of arbitrary type, for example as a plate-type exchanger. By means of the second heat-exchanger, further heat-consumers may, of course, also be supplied with heat for the purpose of residual heating which for the purpose of preheating were supplied with heat by the first heat-exchanger.

In a particularly preferred embodiment of the patent application, which is advantageously suitable for larger district-heat consumer plants, the drinking-water heater is divided up into a first partial drinking-water heater and a second partial drinking-water heater, an upper heat-exchanger being fitted in the first partial drinking-water heater, and a lower heat-exchanger being fitted in the second partial drinking-water heater, and a connecting line being provided from the upper side of the second partial drinking-water heater to the underside of the first partial drinking-water heater. This bipartite structure of the drinking-water heater not only has the known advantages (facilitation in manufacture, assembly, maintenance) but also results in a better separation between the upper (hotter) and the lower (colder) regions of the drinking-water heater or of the heat-exchangers. In this case it is an advantage if the connecting line is linked to the upper point of attachment of the second drinking-water heater and to the lowest point of the first drinking-water heater.

Advantageously, by virtue of the separation of first and second partial drinking-water heaters two zones for heating the cold drinking water can be created. In the first zone with the upper heat-exchanger, the circulated hot drinking water is maintained at its prescribed temperature, so that it gets into the circuit at about 60° C. via a hot-drinking-water outlet and is conducted back again out of said circuit at about 55° C. (or hotter) via the circulation circuit. The loss of heat of the hot drinking water in its circuit is accordingly balanced out by the upper heat-exchanger. In the second zone with the lower heat-exchanger, the cold drinking water supplied via the cold-drinking-water inlet is preheated. In the event of a withdrawal of hot drinking water, cold drinking water is supplied to this lower region, that is to say to the second zone. Consequently, in the lower region, that is to say in the region of the lower heat-exchanger, a lower temperature obtains than in the upper region, in which the upper heat-exchanger is provided. Since the lower heat-exchanger is supplied with warm medium more preferably by the first heat-exchanger, and the upper heat-exchanger is supplied with warm medium more preferably by the second heat-exchanger, an effective heating of the cold drinking water can be enabled. Furthermore, a calcification can be counteracted.

In accordance with the patent application, there is preferably provision that the first heat-exchanger is of the type of a countercurrent heat-exchanger. In the case of a countercurrent heat-exchanger the heat is transferred by the countercurrent principle, also called the countercurrent process. This means that the heat-exchanger is linked in such a way to a primary system and to a secondary system that the media of the primary and secondary systems are conducted past one another in opposite directions in the course of the transfer of heat. More preferably, the second heat-exchanger is of the type of a countercurrent heat-exchanger.

In a preferred embodiment of the patent application, the primary afflux of the first heat-exchanger is capable of being linked to the district-heat reflux via a line, whereby a line opening of the line is capable of being arranged in such a way in the district-heat reflux that the line with the line opening is oriented contrary to a direction of flow of the district-heat reflux. Developing the patent application further, there is preferably provision that the district-heat reflux comprises a line at the port for supplying the district-heat consumer plant with heat from the district-heat reflux, and a line opening of the line is arranged in such a way in the district-heat reflux that the line with the line opening is oriented contrary to a direction of flow of the district-heat reflux. The direction of flow of the district-heat reflux is the direction in which a medium in the district-heat reflux is flowing in the direction of the district heating station. The line is oriented with the line opening contrary to the direction of flow when the surface spanned by the line opening exhibits a normal to the surface facing away from the line and the normal to the surface is at least partially directed against the direction of flow. By virtue of this arrangement of the line opening in the district-heat reflux, it can be ensured that by reason of the pressure and the flow velocity in the district-heat reflux the medium is pressed into the line and is conducted through the line to the first heat-exchanger. Advantageously, the use of a pump can be dispensed with by this means. More preferably, the line opening is inclined at an angle of about 45° relative to the direction of flow. More preferably, the line is of tubular form.

In another preferred embodiment, the primary reflux of the first heat-exchanger is capable of being linked to the district-heat reflux via a line, whereby a line opening of the line is capable of being arranged in such a way in the district-heat reflux that the line with the line opening is oriented in a direction of flow of the district-heat reflux. In accordance with the patent application, there is preferably provision that the district-heat reflux comprises a port with a line for a district-heat consumer plant, in order to route medium cooled by the district-heat consumer plant into the district-heat reflux, and a line opening of the line is arranged in such a way in the district-heat reflux that the line with the line opening is oriented in a direction of flow of the district-heat reflux. The line is oriented with the line opening in the direction of flow when the surface spanned by the line opening exhibits a normal to the surface that faces away from the line and that is at least partially directed in the direction of flow. By virtue of this arrangement of the line opening in the district-heat reflux, by virtue of the medium flowing past the line opening a drop in dynamic pressure may arise in accordance with Bernoulli's law, which can have the effect that an aspirating action arises at the line opening and the medium flows from the first heat-exchanger into the district-heat reflux via the line. In the case of a separately linked primary reflux of the second heat-exchanger, that is to say in the case of a so-called four-conductor system, the primary reflux of the second heat-exchanger is more preferably capable of being linked to the district-heat reflux via a tubular line, whereby a line opening is capable of being arranged in such a way in the district-heat reflux that the line with the line opening is oriented in a direction of flow of the district-heat reflux. More preferably, the line opening of the line via which the primary reflux of the first and/or second heat-exchanger is capable of being linked to the district-heat reflux is inclined at an angle of about 45° relative to the direction of flow. More preferably, this line is of tubular form.

More preferably, the primary afflux and the primary reflux of the first heat-exchanger are linked in such a way to the district-heat reflux that the port of the primary reflux is situated downstream of the port of the primary afflux to the district-heat reflux in the direction of flow. This may prove to be an advantage in the case of a small line diameter of the district-heat reflux.

In a preferred embodiment of the patent application, the district-heat network comprises a district-heat afflux, the district-heat afflux comprising a port for a district-heat consumer plant, in order to supply the district-heat consumer plant with heat from the district-heat afflux. By this means, it can be ensured that heat-consumers of the district-heat consumer plant can be supplied with heat.

Via the ports of the district-heat afflux and/or of the district-heat reflux, in a preferred embodiment of the patent application heat-exchangers of a district-heat consumer plant, for example a first and/or second heat-exchanger according to the patent application, may be capable of being linked, in order to be able to supply the district-heat consumer plant with heat from the district-heat afflux and/or district-heat reflux.

BRIEF DESCRIPTION OF THE DRAWINGS

Further advantageous embodiments will be described in more detail in the following on the basis of three exemplary embodiments represented in the drawings, to which, however, the patent application is not restricted.

DETAILED DESCRIPTION

In the following description of four preferred embodiments of the present patent application, identical reference symbols denote identical or comparable components.

Figure 1:
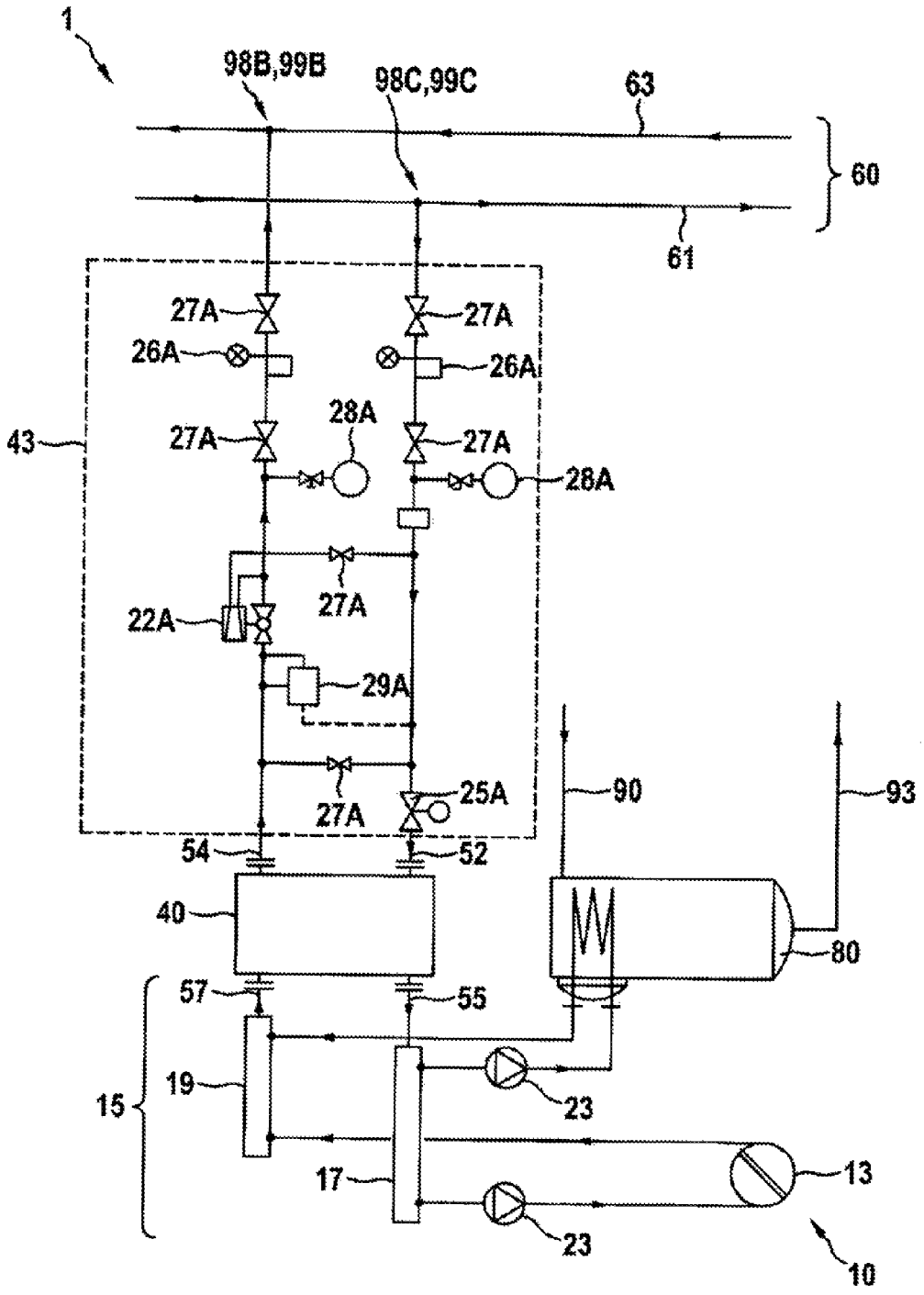
FIG. 1 shows a district-heat system known from the state of the art with a district-heat consumer plant which is linked to a district-heat network.

A district-heat system 1 known from the state of the art with a district-heat consumer plant 10 linked to a district-heat network 60 is represented in FIG. 1. The district-heat consumer plant 10 comprises a port 98C via which the district-heat consumer plant 10 is linked to a district-heat afflux 61 of the district-heat network 60, in order to withdraw heat from the district-heat afflux 61. In addition, the district-heat consumer plant 10 comprises a further port 98B via which the district-heat consumer plant 10 is linked to a district-heat reflux 63. Equally, the district-heat afflux 61 of the district-heat network 60 comprises a port 99C, and the district-heat reflux 63 comprises a port 99B for the district-heat consumer plant 10, in order to supply the district-heat consumer plant 10 with heat from the district-heat afflux 61. Furthermore, the district-heat consumer plant 10 comprises an afflux transfer station 43, which is of the type of a transfer station in order to withdraw heat from the district-heat afflux 61 of the district-heat network 60 via the afflux transfer station 43. The afflux transfer station 43 comprises shut-off valves 27A, bleed valves 26A, manometers 28A, a differential-pressure regulator 22A, a calorimeter 29A and also a motor-driven regulating valve 25A.

In the case of the district-heat consumer plant 10, a second heat-exchanger 40 is linked via a primary afflux 52 to the district-heat afflux 61 and via a primary reflux 54 to a district-heat reflux 63 of the district-heat network 60. The primary afflux 52 of the second heat-exchanger 40 is linked to the district-heat afflux 61 via the motor-driven regulating valve 52 and two serially arranged shut-off valves 27A. Via the motor-driven regulating valve 25A the supply of the medium being conducted in the district-heat afflux 61 is regulated in such a way that the medium flows only in the event of heat demand by the second heat-exchanger 40. The primary reflux 54 of the second heat-exchanger 40 is linked to the district-heat reflux 63 via two serially arranged shut-off valves 27A. Between the two shut-off valves 27A of the primary reflux 54 and also of the primary afflux 52 of the second heat-exchanger 40 a bleed valve 26A is arranged in each instance. In addition, between the shut-off valve 27A, which faces towards the second heat-exchanger 40, and the second heat-exchanger 40 a manometer 28A is arranged in each instance on the primary afflux 52 and on the primary reflux 54, in order to indicate the pressure within the primary afflux 52 and within the reflux 54. This manometer 28A is arranged on the primary afflux 52 between the shut-off valve 27A and the motor-driven regulating valve 25A. Between primary afflux 52 and primary reflux 54 of the second heat-exchanger 40 in addition a differential-pressure regulator 22A and also a calorimeter 29A are arranged. The district-heat consumer plant 10 is accordingly connected to the district-heat network 60 via a calorimeter 29A. The differential-pressure regulator 22A and also the calorimeter 29A are located, as are also the manometers 28A, between the shut-off valve 27A, which faces towards the second heat-exchanger 40, and the second heat-exchanger 40, the calorimeter 29A being located between the second heat-exchanger 40 and the differential-pressure regulator 22A. The motor-driven regulating valve 25A is arranged between the port of the calorimeter 29A and the second heat-exchanger 40. Arranged parallel to the calorimeter 29A is a shut-off valve 27A.

On the secondary side the second heat-exchanger 40 is linked to a heat-consumer system 15 via a secondary afflux 55 and a secondary reflux 57, in order to supply a heat-consumer 13 and a drinking-water heater 80 with heat. For this purpose, the secondary afflux 55 is linked to an afflux 17 of the heat-consumer system 15, and the secondary reflux 57 is linked to a reflux 19 of the heat-consumer system 15. The heat-consumer 13 and the drinking-water heater 80 are in each instance linked to the afflux 17 of the heat-consumer system 15 via a pump 23. The cold drinking water to be heated is supplied to the drinking-water heater 80 via a cold-drinking-water inlet 90, is heated in the former, and leaves the drinking-water heater 80 as hot drinking water via the hot-drinking-water outlet 93.

Such a system is also designated as a two-conductor system, since the district-heat consumer plant 10 is linked to a district-heat network 60 via two ports, namely the primary afflux 51 and the primary reflux 53. In such a system, heat is transferred from the district-heat afflux 61 of the district-heat network 60 to the heat-consumer 13 via the second heat-exchanger 40. In such a district-heat consumer plant 10 constructed as a two-conductor system there may be a risk that the temperature of the medium being conducted in the district-heat reflux 63 rises considerably. This may be detrimental to an economical operation of the district-heat network 60.

Figure 2:
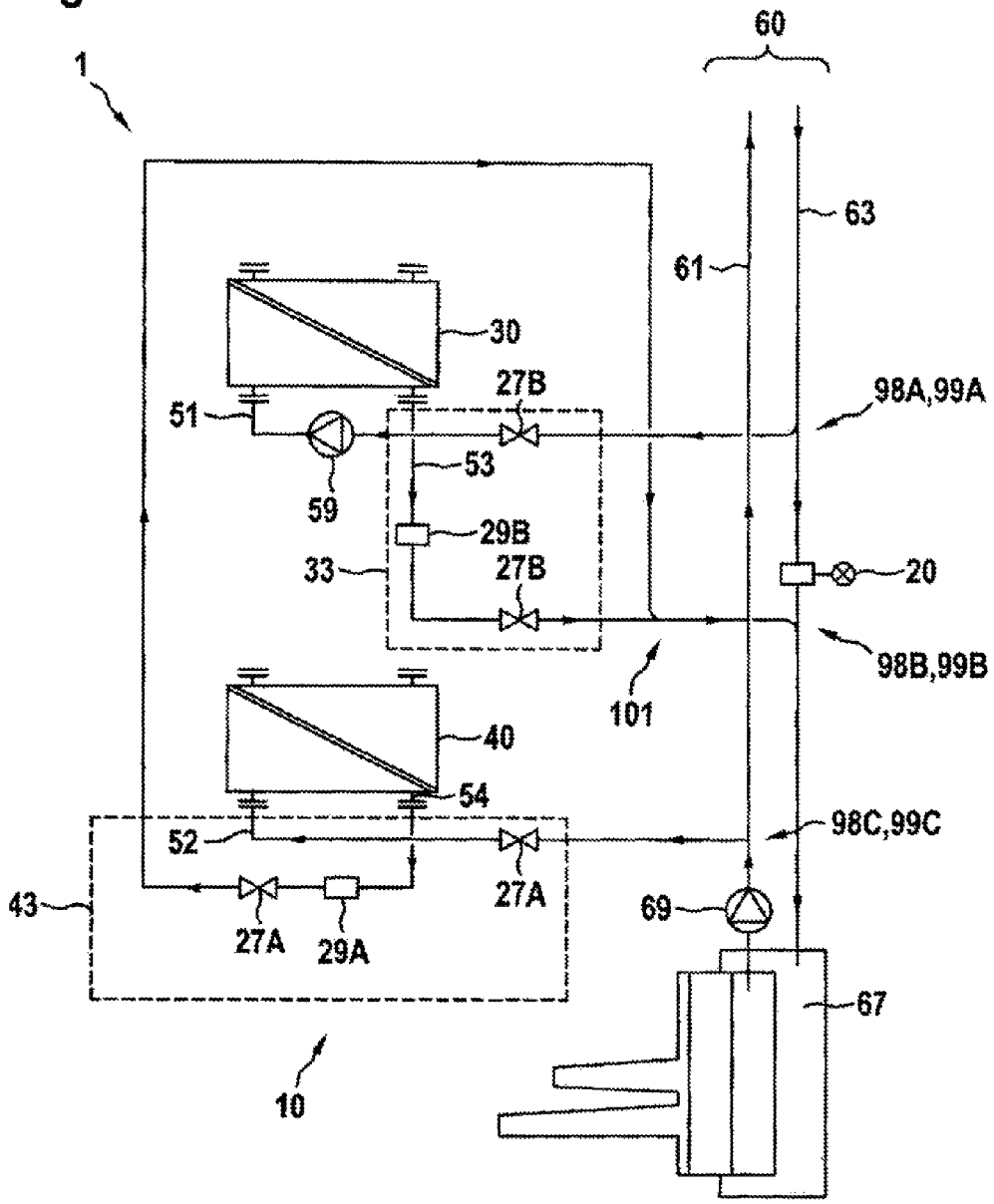
FIG. 2 shows a district-heat system with a district-heat consumer plant linked to a district-heat network and with three ports to the district-heat network.
Figure 3:
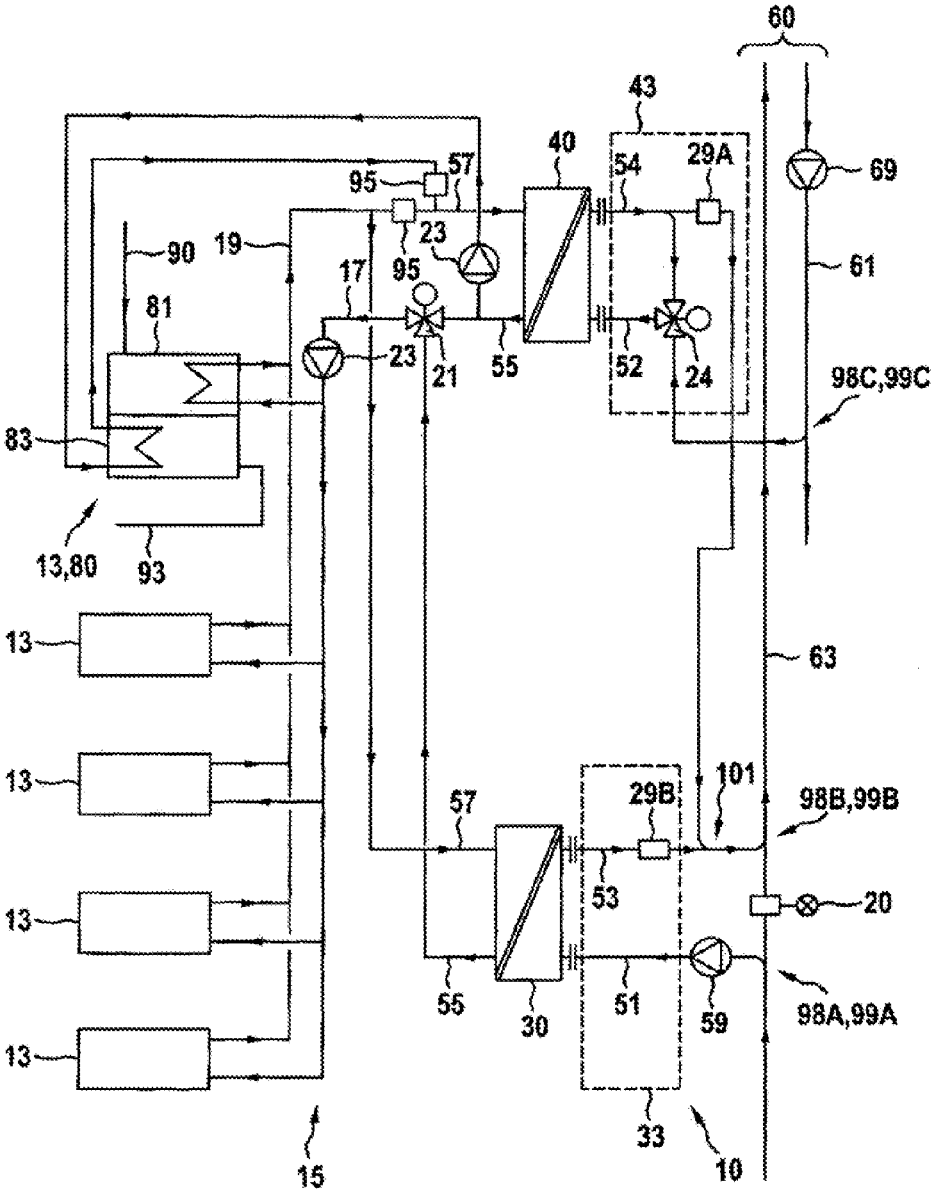
FIG. 3 shows a district-heat system with a district-heat consumer plant linked to a district-heat network with a heat-consumer system and with three ports to the district-heat network.
Figure 4:
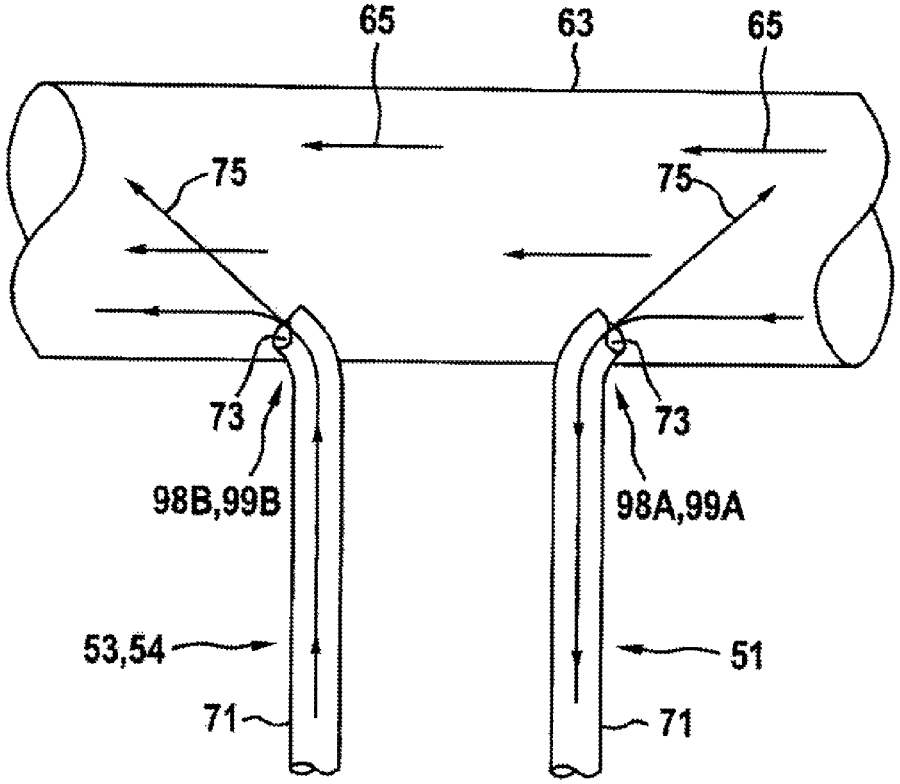
FIG. 4 shows the port of the primary afflux of the first heat-exchanger and also of the primary reflux of the first and second heat-exchangers to the district-heat reflux.

The first exemplary embodiment will be elucidated in the following on the basis of FIGS. 2 to 4. In FIG. 2 a schematic representation is shown of a district-heat system 1 with a district-heat network 60 and with a district-heat consumer plant 10 with three ports to the district-heat network 60 for the purpose of supplying heat to heat-consumers 13 from the district-heat network 60. FIG. 3 shows a schematic representation of a district-heat system with a district-heat network 60 and with a district-heat consumer plant 10 with a heat-consumer system 15 and with three ports to the district-heat network 60. In FIG. 4 a schematic representation of the port of the primary afflux 51 of the first heat-exchanger 30 and also of the primary reflux 53 of the first heat-exchanger 30 and of the primary reflux 54 of the second heat-exchanger 40 to the district-heat reflux 63 is represented. In the exemplary embodiment shown in FIGS. 2 to 4 it is a question of a three-conductor system which is supplied with heat via a district-heat network 60. For this purpose, a heated medium is conveyed from a district heating station 67 through a district-heat pump 69 via the district-heat afflux 61 to the district-heat consumer plant 10 which is constructed as a three-conductor system.

The district-heat consumer plant 10 comprises four heat-consumers 13 and also a drinking-water heater 80 constructed as a heat-consumer 13, which are capable of being supplied with heat from the district-heat network 60. The district-heat consumer plant 10 comprises a port 98A via which the district-heat consumer plant 10 is linked to a district-heat reflux 63 of the district-heat network 60, in order to withdraw heat from the district-heat reflux 63 for the purpose of supplying it to the heat-consumers 13. Furthermore, the district-heat consumer plant 10 comprises a port 98B via which the district-heat consumer plant 10 is linked to the district-heat reflux 63. Via the port 98B, a medium that was withdrawn from the district-heat reflux 63 via the port 98A can again be routed into the district-heat reflux 63. The district-heat reflux 63 of the district-heat network 60 comprises a port 99A for the district-heat consumer plant 10, in order to supply the district-heat consumer plant 10 with heat from the district-heat reflux 63. The district-heat reflux 63 further comprises a port 99B for the district-heat consumer plant 10. Via the port 99B, a medium that was withdrawn from the district-heat reflux 63 via the port 99A can again be routed into the district-heat reflux 63.

Furthermore, the district-heat consumer plant 10 comprises a reflux transfer station 33, which is of the type of a transfer station in order to withdraw heat from the district-heat reflux 63 via the reflux transfer station 33. In order to transfer heat from the district-heat reflux 63 to heat-consumers 13, the district-heat consumer plant 10 comprises a first heat-exchanger 30 with a primary afflux 51 which is linked to the district-heat reflux 63 of the district-heat network 60 via the reflux transfer station 33. The primary afflux 51 of the first heat-exchanger 30 is in this case linked via the port 98A of the district-heat consumer plant 10 to the port 99A of the district-heat network 60 and consequently to the district-heat reflux 63. Furthermore, the first heat-exchanger 30 comprises a primary reflux 53 which is linked to the district-heat reflux 63 via the reflux transfer station 33. The primary reflux 53 of the first heat-exchanger 30 is in this case linked via the port 98B of the district-heat consumer plant 10 to the port 99B of the district-heat network 60 and consequently to the district-heat reflux 63. The district-heat consumer plant 10 accordingly comprises a first heat-exchanger 30 with a primary afflux 51 and with a primary reflux 53, the primary afflux 51 and the primary reflux 53 of the first heat-exchanger 30 being linked to the district-heat reflux 63 via the reflux transfer station 33, in order to withdraw heat from the district-heat reflux 63. The reflux transfer station 33 comprises shut-off valves 27B, bleed valves, manometers, a differential-pressure regulator, a calorimeter 29B and also a motor-driven regulating valve, which for reasons of representation are only shown in part in FIGS. 2 and 3 and which are interconnected as represented in FIG. 1.

The primary afflux 51 and the primary reflux 53 of the first heat-exchanger 30 are linked in such a way to the district-heat reflux 63 that the port 98B is situated downstream of the port 98A of the district-heat consumer plant 10 in the direction of flow 65. Equally, the port 99B is situated downstream of the port 99A of the district-heat reflux 63 in the direction of flow 65. In this case, between the port 98B, 99B and the port 98A, 99A a throttle valve 20 is arranged in the district-heat reflux 63. By means of this throttle valve 20, the flow pressure in the district-heat reflux 63 can be controlled in such a way that the pressure and/or the flow velocity in the primary afflux 51 of the first heat-exchanger 30 is increased. By this means, the heat is transferred more effectively to the heat-consumers 13.

Between the primary afflux 51 of the first heat-exchanger 30 and the port 98A, 99A to the district-heat reflux 63 a feed pump 59 is arranged. By means of the feed pump 59, the medium which is flowing in the direction of flow 65 through the district-heat reflux 63 to the district heating station 67 can flow out of the district-heat reflux 63 through the primary afflux 51 into the first heat-exchanger 30, can perfuse the latter, and furthermore flow back again through the primary reflux 53 of the first heat-exchanger 30 into the district-heat reflux 63. While the medium is perfusing the first heat-exchanger 30, heat is transferred from the primary side of the first heat-exchanger 30 to the secondary side of the first heat-exchanger 30.

The district-heat consumer plant 10 comprises a port 98C via which the district-heat consumer plant 10 is linked to the district-heat afflux 61 and to the district-heat reflux 63 of the district-heat network 60, in order to withdraw heat from the district-heat afflux 61. Similarly, the district-heat afflux 61 comprises a port 99C for the district-heat consumer plant 10, in order to supply the district-heat consumer plant 10 with heat from the district-heat afflux 61.

Furthermore, the district-heat consumer plant 10 comprises an afflux transfer station 43, which is of the type of a transfer station in order to withdraw heat from the district-heat afflux 61 via the afflux transfer station 43. For this purpose, the district-heat consumer plant 10 comprises a second heat-exchanger 40 with a primary afflux 52 and with a primary reflux 54, the primary afflux 52 of the second heat-exchanger 40 being linked via the afflux transfer station 43 to the district-heat afflux 61 of the district-heat network 60, and the primary reflux 54 being linked via the afflux transfer station 43 to the district-heat reflux 63, in order to withdraw heat from the district-heat afflux 61. The primary afflux 52 of the second heat-exchanger 40 is in this case linked via the port 98C of the district-heat consumer plant 10 to the port 99C of the district-heat network 60 and consequently to the district-heat afflux 61. The primary afflux 52 and the primary reflux 54 of the second heat-exchanger 40 are accordingly linked via the afflux transfer station 43 to the district-heat afflux 61 and to the district-heat reflux 63. The afflux transfer station 43 comprises shut-off valves 27A, bleed valves, manometers, a differential-pressure regulator, a calorimeter 29A and also a jet pump 24, which for reasons of representation are only shown in part in FIGS. 2 and 3 and which are interconnected as shown in FIG. 1. In this case, instead of the regulating valve 25A shown in FIG. 1 between the primary afflux 52 of the second heat-exchanger 40 and the district-heat afflux 61 there is arranged a jet pump 24 which by its working-fluid port is linked to the district-heat afflux 61 and by its suction port is linked to a primary reflux 54 of the second heat-exchanger 40. For the purpose of better and more effective transfer of heat, the first heat-exchanger 30 and the second heat-exchanger 40 are of the type of a countercurrent heat-exchanger, whereby the heat is capable of being transferred by the countercurrent principle.

The primary reflux 53 of the first heat-exchanger 30 and the primary reflux 54 of the second heat-exchanger 40 are connected to one another and are jointly linked to the district-heat reflux 63 of the district-heat network 60. The primary reflux 54 of the second heat-exchanger 40 is accordingly connected to the primary reflux 53 of the first heat-exchanger 30 and via the port 98B of the district-heat consumer plant 10 linked to the port 99B of the district-heat network 60 and consequently to the district-heat reflux 63. In this case the reflux transfer station 33 is arranged between the common connecting node 101 of the primary reflux 53, 54 of the first heat-exchanger 30 and second heat-exchanger 40 and the first heat-exchanger 30, and the afflux transfer station 43 is arranged between the common connecting node 101 of the primary reflux 53, 54 of the first heat-exchanger 30 and second heat-exchanger 40 and the second heat-exchanger 40. The primary reflux 53 of the first heat-exchanger 30 and the primary reflux 54 of the second heat-exchanger 40 are accordingly connected to one another downstream of the respective calorimeters 29A, 29B. For the purpose of transfer of heat by means of the second heat-exchanger 40, a medium flows out of the district-heat afflux 61 through the afflux transfer station 43 via the primary afflux 52 of the second heat-exchanger 40, perfuses the latter and flows through the afflux transfer station 43 into the district-heat reflux 63 via the primary reflux 54 of the second heat-exchanger 40.

The district-heat consumer plant 10 comprises a heat-consumer system 15 which is capable of being supplied with heat by the first heat-exchanger 30. For reasons of representation, the heat-consumer system 15 is not shown in FIG. 2. The heat-consumer system 15 is linked to the secondary side of the first heat-exchanger 30, the secondary afflux 55 of the first heat-exchanger 30 being linked to the afflux 17 of the heat-consumer system 15, and the secondary reflux 57 of the first heat-exchanger 30 being linked to the reflux 19 of the heat-consumer system 15. To the heat-consumer system 15 there are linked heat-consumers 13, in order to be supplied with heat by the first heat-exchanger 30 via the heat-consumer system 15. For this purpose, the heat-consumers 13 are connected to the afflux 17 of the heat-consumer system and to the reflux 19 of the heat-consumer system 15, whereby warm medium of the heat-consumer system 15 is delivered to the heat-consumer 13 via the afflux 17 of the heat-consumer system, said medium being cooled by the heat-consumer 13 and conducted back again into the reflux 19 of the heat-consumer system. The heat-consumer system 15 is constructed as a circuit and comprises a pump 23, in order to pump the medium of the heat-consumer system 15 through the lines of the heat-consumer system 15 from the first heat-exchanger 30 to a heat-consumer 13 and back again.

To the heat-consumer system 15 there are linked four heat-consumers 13 constructed as heating circuits, in order to be supplied with heat by the first heat-exchanger 30 via the heat-consumer system 15. The heat-consumers 13 are in each instance constructed as low-temperature heating circuits for underfloor heating systems, ceiling and wall heating systems and also for heating systems of swimming-pool water, and are supplied with heat from the district-heat reflux 63 via the first heat-exchanger 30.

Furthermore, the district-heat consumer plant 10 comprises a drinking-water heater 80 for the purpose of heating hot drinking water, which is capable of being supplied with heat by the first heat-exchanger 30 for the purpose of preheating the hot drinking water. For this purpose, the drinking-water heater 80 comprises a first partial drinking-water heater 81, which may also be designated as a preheater, the first partial drinking water heater 81 being capable of being supplied with heat by the first heat-exchanger 30 via the heat-consumer system 15 for the purpose of preheating the hot drinking water. For this purpose, the first partial drinking-water heater 81 is connected to the afflux 17 and to the reflux 19 of the heat-consumer system 15. The first partial drinking-water heater 81 is constructed as a heat-exchanger and arranged in a lower region of the drinking-water heater 80. By means of the first partial drinking-water heater 81 the temperature of the hot drinking water can be preheated from 10° C. up to 40° C.

The second heat-exchanger 40 is connected on the secondary side to a second partial drinking-water heater 83 of the drinking-water heater 80, so that the district-heat consumer plant 10 comprises a drinking-water heater 80 for the purpose of heating hot drinking water to 60° C., which is capable of being supplied with heat by the second heat-exchanger 40 for the purpose of residual heating of the hot drinking water. For this purpose, the secondary afflux 55 of the second heat-exchanger 40 is connected to the second partial drinking-water heater 83 via a pump 23, which acts as a charge pump, and the secondary reflux 57 of the second heat-exchanger 40 is connected to the second partial drinking-water heater 83 via a check valve 95. The medium which has been heated in the second heat-exchanger flows from the secondary afflux 55 of the second heat-exchanger 40 via the pump 23 to the second partial drinking-water heater 83, perfuses the latter for the purpose of residual heating of the hot drinking water to 60° C., and subsequently flows from the second partial drinking-water heater 83 through a check valve via the secondary reflux 57 of the second heat-exchanger 40 back into the second heat-exchanger 40, in order to be heated again there. The second partial drinking-water heater 83 is constructed as a heat-exchanger and arranged in an upper region of the drinking-water heater 80.

The cold drinking water to be heated is supplied to the drinking-water heater 80 via a cold-drinking-water inlet 90, is heated in the latter, and leaves the drinking-water heater as hot drinking water via the hot-drinking-water outlet 93, in order to be conducted to the consumers. In this case the cold drinking water firstly flows into the first partial drinking-water heater 81 and subsequently into the second partial drinking-water heater 83.

In addition, the district-heat consumer plant 10 comprises a three-way valve 21 constructed as a mixing valve, through which the heat-consumer system 15 is capable of being supplied with heat by the second heat-exchanger 40 of the district-heat consumer plant 10. For this purpose, the three-way valve 21 is linked to the afflux 17 of the heat-consumer system, to the secondary afflux 55 of the first heat-exchanger 30 and to the secondary afflux 55 of the second heat-exchanger 40. Through the three-way valve 21 the heat-consumer system 15 can be supplied with heat on demand by the second heat-exchanger 40. Accordingly, should the medium in the heat-consumer system 15 not be heated sufficiently by the first heat-exchanger 30, medium that has been heated by the second heat-exchanger 40 can be admixed via the three-way valve 21. Via the three-way valve 21 the heat-consumer system 15 can be supplied with heat by the first heat-exchanger 30 and/or the second heat-exchanger 40. This may, for example, be an advantage in the case of an insufficient delivery of heat by the first heat-exchanger 30 by reason of a temperature of the district-heat reflux 63 that is too low, in the case of a defective first heat-exchanger 30, or in the case of peak loads. In order to enable a closed circuit of the distributor system 15, the reflux 19 of the heat-consumer system 15 is linked to the secondary reflux 57 of the second heat-exchanger via a check valve 95.

The primary afflux 51 of the first heat-exchanger 30 is, as shown in FIG. 4, linked to the district-heat reflux 63 via a tubular line 71, whereby a line opening 73 of the line 71 is arranged in such a way in the district-heat reflux 63 that the line 71 with the line opening 73 is oriented contrary to a direction of flow 65 of the district-heat reflux 63. This corresponds to the line 71, which the district-heat reflux 63 comprises on the port 99A for the purpose of supplying the district-heat consumer plant 10 with heat from the district-heat reflux 63. A line opening 73 of the line 71 is arranged in such a way in the district-heat reflux 63 that the line 71 with the line opening 73 is oriented contrary to a direction of flow 65 of the district-heat reflux 63. In this case the surface spanned by the line opening 73 exhibits a normal to the surface 75, which faces away from the line 71 and is directed against the direction of flow 65, the normal to the surface 75 and the direction of flow 65 including an angle of about 45°. The line opening 73 is accordingly inclined at an angle of about 45° relative to the direction of flow 65. Such an arrangement is also designated as shoeing of the line 71 into the district-heat reflux 63. By this means, the medium being conducted in the district-heat reflux 63 is supplied to the first heat-exchanger 30 by virtue of an injector effect.

Furthermore, as likewise shown in FIG. 4, the primary reflux 53 of the first heat-exchanger 30 and the primary reflux 54 of the second heat-exchanger 40 are linked to the district-heat reflux 63 via a tubular line, whereby a line opening 73 of the line 71 is arranged in such a way in the district-heat reflux 63 that the line 71 with the line opening 73 is oriented in a direction of flow 65 of the district-heat reflux 63. This line corresponds to the line 71, which is arranged on a port 99B of the district-heat reflux 63 via which the medium cooled by the first heat-exchanger 30 and/or second heat-exchanger 40 can again be routed into the district-heat reflux. The district-heat reflux 63 accordingly comprises a port 99B with a line 71 for a district-heat consumer plant 10, in order to route medium cooled by the district-heat consumer plant 10 into the district-heat reflux 63, whereby a line opening 73 of the line 71 is arranged in such a way in the district-heat reflux 63 that the line 71 with the line opening 73 is oriented in a direction of flow 65 of the district-heat reflux 63. In this case the surface spanned by the line opening 73 exhibits a normal to the surface 75, which faces away from the line 71 and is directed in the direction of flow 65, the normal to the surface 75 and the direction of flow 65 including an angle of about 45°. Such an arrangement of the line 71 on the district-heat reflux 63 is ordinarily designated as shoeing. In this case, according to Bernoulli's law a drop in dynamic pressure may arise by virtue of the medium flowing past the line opening 73, which has the effect that the medium located in the line 71 flows out of the line 71 into the district-heat reflux 63. In FIG. 4 the throttle valve 20 is not shown, for reasons of representation.

Figure 5:
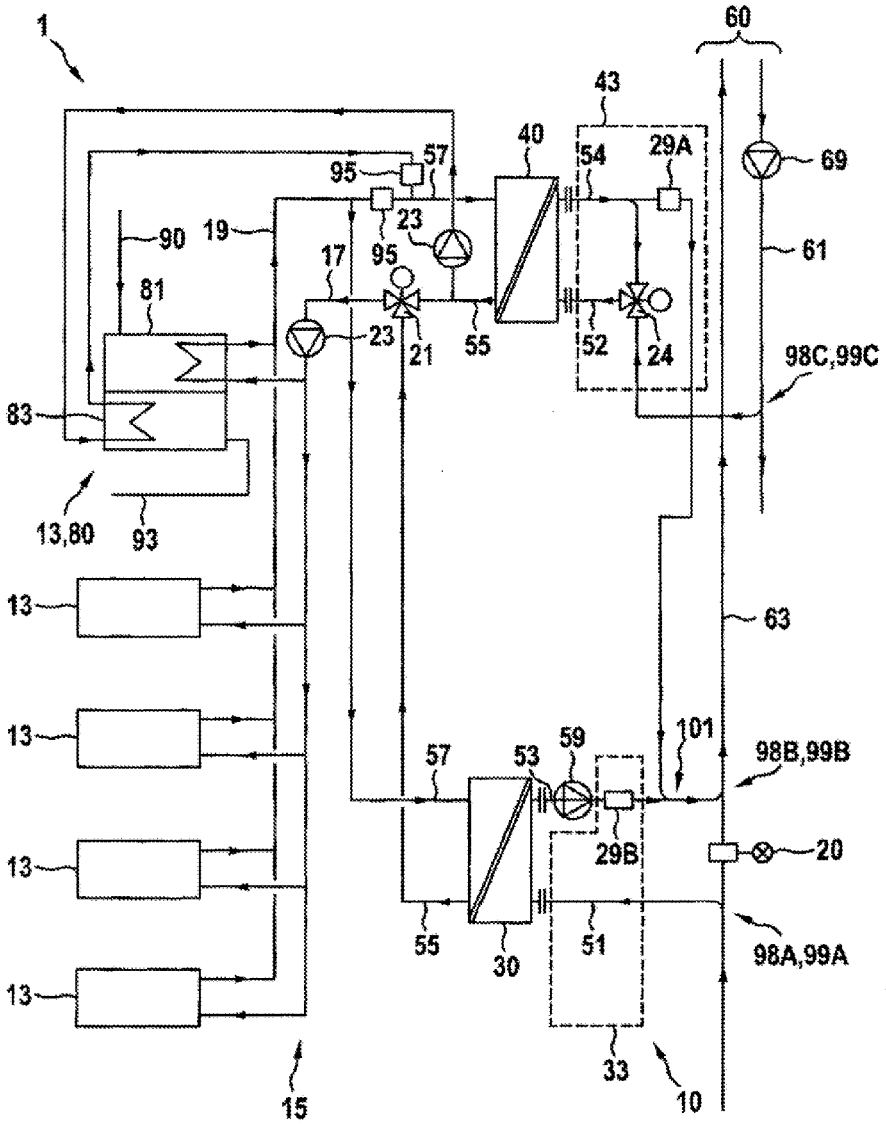
FIG. 5 shows a district-heat system with a district-heat consumer plant linked to a district-heat network with three ports to the district-heat network in a further embodiment.

In a second exemplary embodiment, represented in FIG. 5, which otherwise does not differ from the first exemplary embodiment, the feed pump 59 is arranged between the primary reflux 53 of the first heat-exchanger 30 and the district-heat reflux 63. By this means, the suction effect of the feed pump 59 is improved, resulting in an improvement of the transfer of heat of the first heat-exchanger 30. This is an advantage, above all, in the case of high pressures and/or high flow velocities within the district-heat reflux 63.

Figure 6:
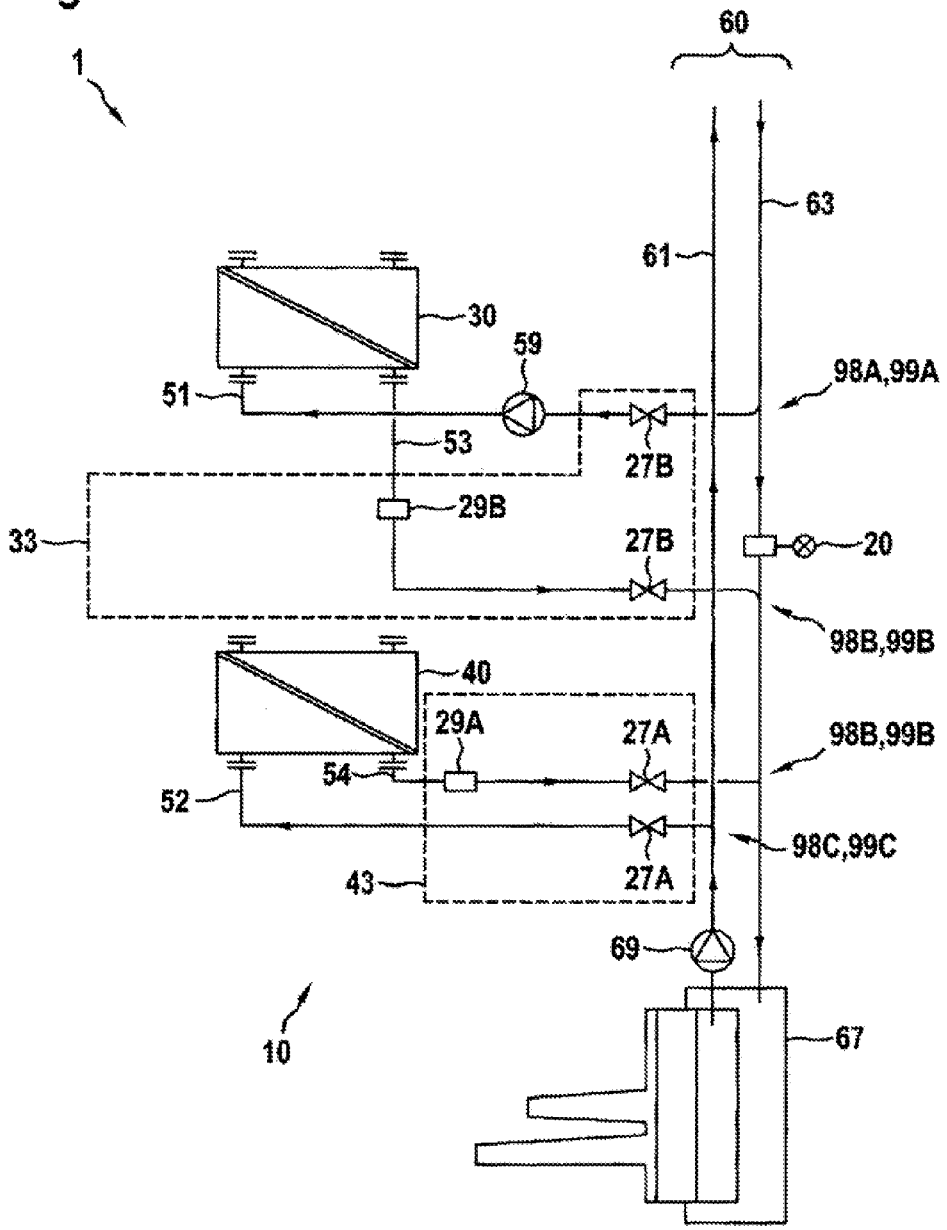
FIG. 6 shows a district-heat system with a district-heat consumer plant linked to a district-heat network with four ports to the district-heat network.
Figure 7:
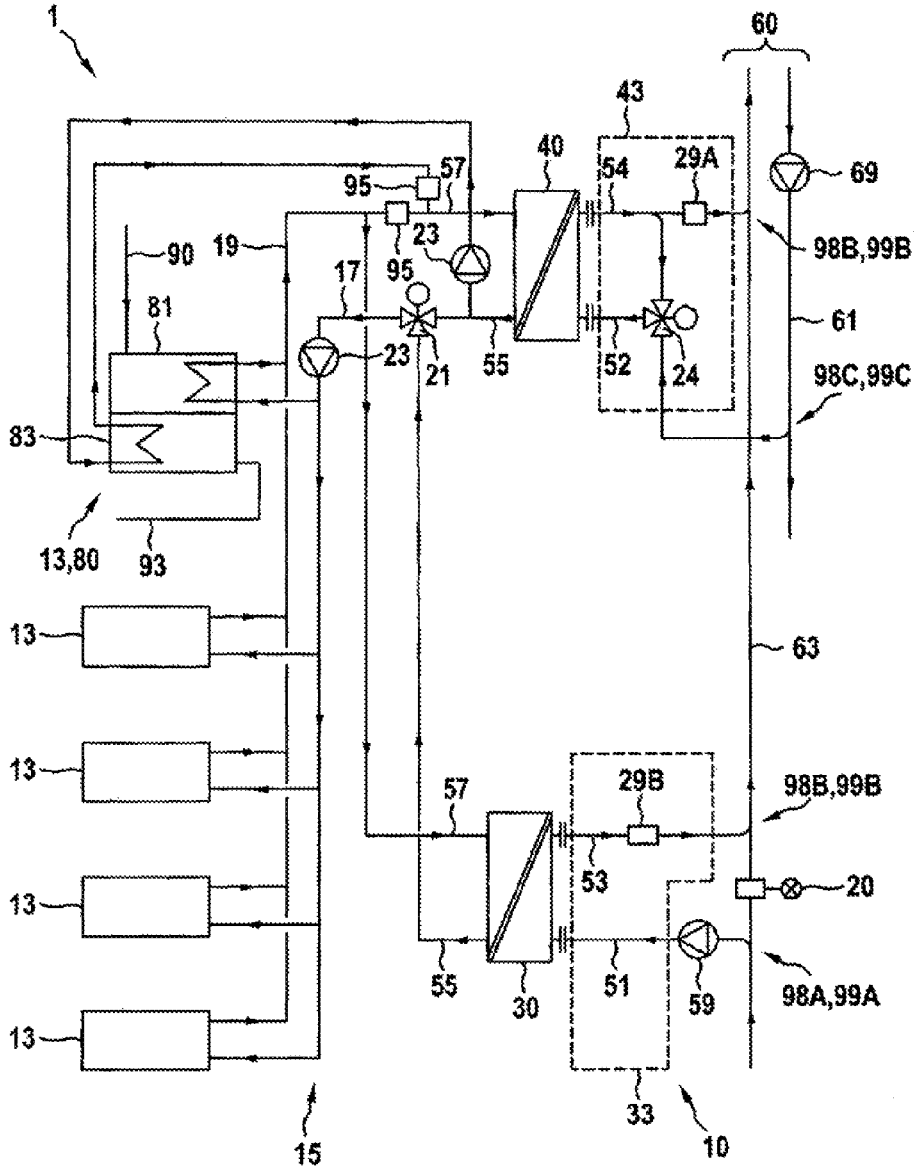
FIG. 7 shows a district-heat system with a district-heat consumer plant linked to a district-heat network with a heat-consumer system and with four ports to the district-heat network.

In a third exemplary embodiment, represented in FIGS. 6 and 7, which otherwise does not differ from the first exemplary embodiment, the primary reflux 53 of the first heat-exchanger 30 and the primary reflux 54 of the second heat-exchanger 40 are linked to the district-heat reflux 63 of the district-heat network 60 separately from one another. The primary reflux 53 of the first heat-exchanger 30 and the primary reflux 54 of the second heat-exchanger 40 are accordingly linked, separately from one another, via a port 98B of the district-heat consumer plant 10 to a port 99B of the district-heat network 60, and consequently to the district-heat reflux 63. The first heat-exchanger 30 and the second heat-exchanger 40 accordingly comprise a primary reflux 53, which are not at first connected to one another, in order subsequently to be linked to the district-heat reflux 63, but are linked to the district-heat reflux 63 via separate lines. In the case of the district-heat consumer plant 10 represented in FIGS. 6 and 7 it is accordingly a question of a four-conductor system, since the district-heat consumer plant 10 comprises four ports to the district-heat network 60. These are the primary afflux 51 of the first heat-exchanger 30, the primary afflux 52 of the second heat-exchanger 40, and also the primary reflux 53 of the first heat-exchanger 30 and the primary reflux 54 of the second heat-exchanger 40. In this case the primary afflux 51 of the first heat-exchanger 30 and also the primary reflux 53 of the first heat-exchanger 30 and the primary reflux 54 of the second heat-exchanger 40 are linked to the district-heat reflux 63 via tubular lines 71, as represented in FIG. 4.

Figure 8:
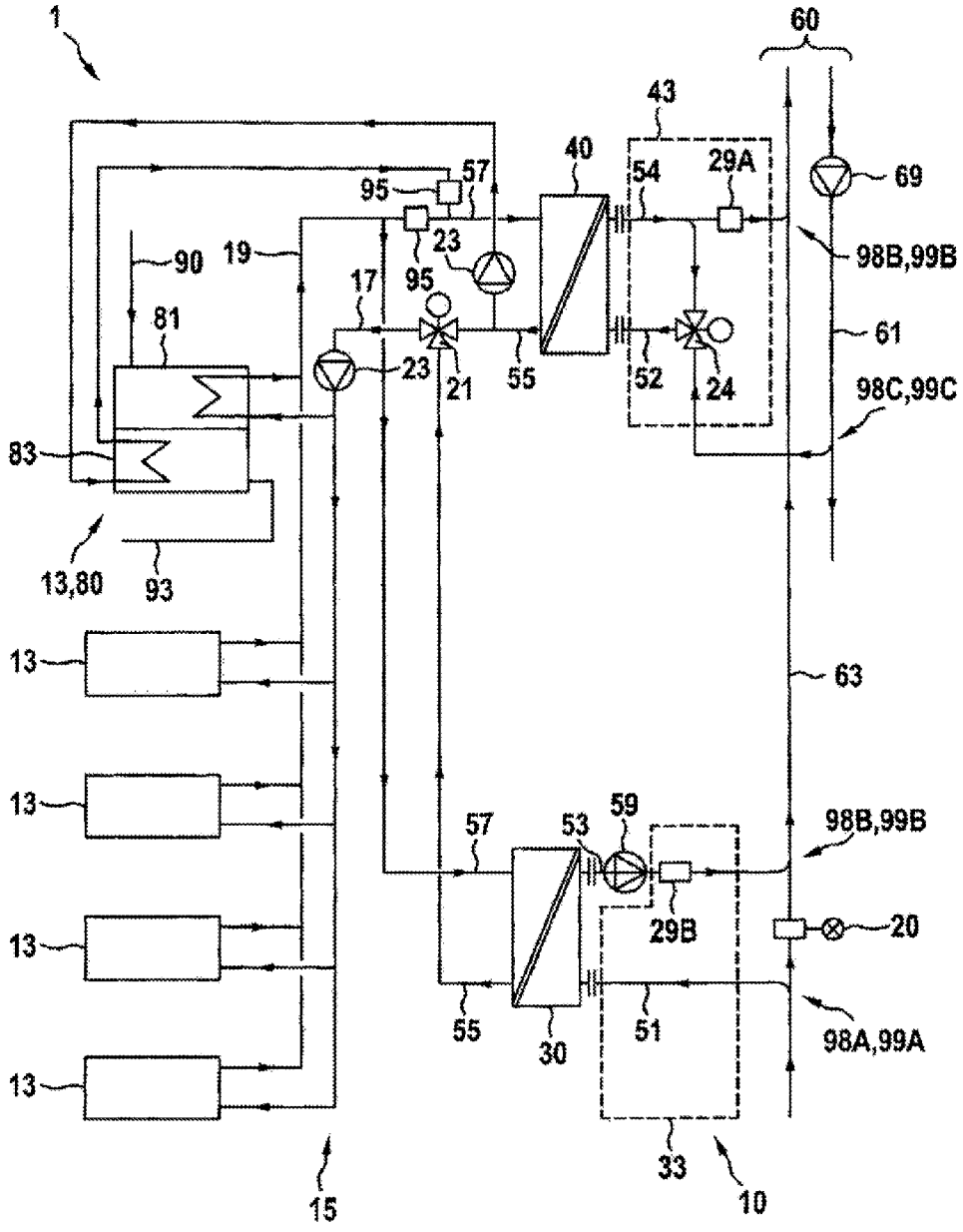
FIG. 8 shows a district-heat consumer plant with four ports to the district-heat network in a further embodiment.

In a fourth exemplary embodiment, represented in FIG. 8, which otherwise does not differ from the third exemplary embodiment, the feed pump 59 is arranged between the primary reflux 53 of the first heat-exchanger 30 and the district-heat reflux 63. By this means, as already elucidated for the second exemplary embodiment, the suction effect of the feed pump 59 is improved, resulting in an improvement of the transfer of heat of the first heat-exchanger 30. This is an advantage, above all, in the case of high pressures and/or high flow velocities within the district-heat reflux 63.

The features disclosed in the above description, in the claims and in the drawings may be of significance, both individually and in arbitrary combination, for the realisation of the patent application in its various embodiments.

LIST OF REFERENCE SYMBOLS

1 district-heat system
10 district-heat consumer plant
13 heat-consumer
15 heat-consumer system
17 afflux of the heat-consumer system
19 reflux of the heat-consumer system
21 throttle valve
21 three-way valve
22A differential-pressure regulator of the afflux transfer station
23 pump
24 jet pump
25A regulating valve of the afflux transfer station
26A bleed valve of the afflux transfer station
27A shut-off valve of the afflux transfer station
27B shut-off valve of the reflux transfer station
28A manometer of the afflux transfer station
29A calorimeter of the afflux transfer station
29B calorimeter of the reflux transfer station
30 first heat-exchanger
33 reflux transfer station
40 second heat-exchanger
43 afflux transfer station
51 primary afflux of the first heat-exchanger
52 primary afflux of the second heat-exchanger
53 primary reflux of the first heat-exchanger
54 primary reflux of the second heat-exchanger
55 secondary afflux
57 secondary reflux
59 feed pump
60 district-heat network
61 district-heat afflux
63 district-heat reflux
65 direction of flow
67 district heating station
69 district-heat pump
71 line
73 line opening
75 normal to the surface
80 drinking-water heater
81 first partial drinking-water heater
83 second partial drinking-water heater
90 cold-drinking-water inlet
93 hot-drinking-water outlet
95 check valve
98A port of the district-heat consumer plant
98B port of the district-heat consumer plant
98C port of the district-heat consumer plant
99A port of the district-heat reflux
99B port of the district-heat reflux
99C port of the district-heat afflux
101 connecting node The claimed invention is:

1. A district-heat consumer plant, which is linked to a district-heat network having a district-heat afflux and a district-heat reflux, comprising:

at least one heat-consumer which is supplied with heat from the district-heat network;

an afflux supply port via which the district-heat consumer plant is linked to the district-heat afflux of the district-heat network;

an afflux transfer station comprising an afflux heat exchanger, the afflux heat exchanger comprising a primary side and a secondary side, a primary afflux of the afflux heat exchanger being in flow communication with the afflux supply port, in order to withdraw heat from the district-heat afflux; and a reflux return port in flow communication with a primary reflux of the afflux heat exchanger via which the district-heat consumer plant is linked to the district-heat reflux of the district-heat network; and a reflux supply port via which the district-heat consumer plant is linked to the district-heat reflux of the district-heat network;

a reflux transfer station comprising a reflux heat exchanger, the reflux heat exchanger comprising a primary side and a secondary side, a primary afflux of the reflux heat exchanger being in flow communication with the reflux supply port, in order to withdraw heat from the district-heat reflux; and a reflux return port in flow communication with the heat exchanger via which the district-heat consumer plant is linked to the district-heat reflux of the district-heat network, and a mixing valve, wherein a secondary afflux of the afflux heat exchanger and a secondary afflux of the reflux heat exchanger are linked to the mixing valve, the mixing valve being configured for supplying heat to the at least one heat consumer.

2. A district-heat consumer plant of claim 1, wherein the at least one heat-consumer is a low-energy consumer system or a low-temperature system.

3. A district-heat consumer plant of claim 2, wherein the at least one heat-consumer is a low-energy consumer system selected from an underfloor heating system, a wall heating system and a ceiling heating system.

4. A district-heat consumer plant of claim 2, wherein the at least one heat-consumer is a low-temperature system selected from a low energy house, a low-temperature heating plant, and a low-temperature de-aerating plant.

5. A district-heat consumer plant of claim 1 further comprising a feed pump in flow communication with the district heat-reflux and with the reflux supply port and positioned downstream of the reflux supply port.

6. A district-heat consumer plant of claim 1, wherein the reflux supply port is a line within the district-heat reflux inclined at an angle of about 45° relative to the direction of flow.

7. A district-heat consumer plant of claim 1, wherein the reflux return port is a line within the district-heat reflux inclined at an angle of about 45° relative to the direction of flow.

8. A district-heat consumer plant of claim 1, wherein the reflux supply port is a line within the district-heat reflux inclined at an angle of about 45° relative to the direction of flow, and wherein the reflux supply port is a line within the district-heat reflux inclined at an angle of about 45° relative to the direction of flow.

9. A district-heat network having a district-heat afflux and a district-heat reflux, comprising:

at least one heat-consumer;

an afflux supply port via which a district-heat consumer plant is linked to the district-heat afflux of the district-heat network;

an afflux transfer station comprising an afflux heat exchanger, the afflux heat exchanger comprising a primary side and a secondary side, a primary afflux of the afflux heat exchanger being in flow communication with the afflux supply port, in order to withdraw heat from the district-heat afflux; and a reflux return port in flow communication with a primary reflux of the afflux heat exchanger via which the district-heat consumer plant is linked to the district-heat reflux of the district-heat network; and a reflux supply port via which the district-heat consumer plant is linked to the district-heat reflux of the district-heat network;

a reflux transfer station comprising a reflux heat exchanger, the reflux heat exchanger comprising a primary side and a secondary side, a primary afflux of the reflux heat exchanger being in flow communication with the reflux supply port, in order to withdraw heat from the district-heat reflux; and a reflux return port in flow communication with a primary reflux of the reflux heat exchanger via which the district-heat consumer plant is linked to the district-heat reflux of the district-heat network, and a mixing valve, wherein a secondary afflux of the afflux heat exchanger and a secondary afflux of the reflux heat exchanger are linked to the mixing valve, the mixing valve being configured for supplying heat to the at least one heat consumer.

10. A district-heat network of claim 9 further comprising a connecting node in place of the reflux return port in flow communication with the afflux heat exchanger, the connecting node being in flow communication with the afflux heat exchanger and with the reflux heat exchanger and also being in flow communication with a reflux return port whereby the flow from the afflux heat exchanger and the flow from the reflux heat exchanger combine prior to the reflux return port via which the district-heat consumer plant is linked to the district-heat reflux of the district-heat network.

11. A district-heat network of claim 10, wherein the reflux return port is a line within the district-heat reflux inclined at an angle of about 45° relative to the direction of flow.

12. A district-heat network of claim 9, wherein the at least one heat-consumer is a low-energy consumer system or a low-temperature system.

13. A district-heat network of claim 12, wherein the at least one heat-consumer is a low-energy consumer system selected from an underfloor heating system, a wall heating system and a ceiling heating system.

14. A district-heat network of claim 12, wherein the at least one heat-consumer is a low-temperature system selected from a low energy house, a low-temperature heating plant, and a low-temperature de-aerating plant.

15. A district-heat network of claim 9 further comprising a feed pump in flow communication with the district heat-reflux and with the reflux supply port and positioned downstream of the reflux supply port.

16. A district-heat network of claim 9, wherein the reflux supply port is a line within the district-heat reflux inclined at an angle of about 45° relative to the direction of flow.

17. A district-heat network of claim 9, wherein the reflux return port is a line within the district-heat reflux inclined at an angle of about 45° relative to the direction of flow.

18. A district-heat network of claim 9, wherein the reflux supply port is a line within the district-heat reflux inclined at an angle of about 45° relative to the direction of flow, and wherein the reflux supply port is a line within the district-heat reflux inclined at an angle of about 45° relative to the direction of flow.

19. A district-heat network of claim 9, wherein the mixing valve is configured for admixing medium heated by the afflux heat exchanger to the medium heated by the reflux heat exchanger.

20. A district-heat network of claim 10, wherein the district-heat consumer plant is constructed as a three-conductor system.

* * * * *